US006429131B2

(12) United States Patent
Lin et al.

(10) Patent No.: US 6,429,131 B2
(45) **Date of Patent: *Aug. 6, 2002**

(54) CMP UNIFORMITY

(75) Inventors: Chenting Lin, Poughkeepsie; Robert van den Berg, Hopewell Junction; Sumit Pandey, Wappingers Falls, all of NY (US)

(73) Assignee: Infineon Technologies AG

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/271,684

(22) Filed: Mar. 18, 1999

(51) Int. Cl.[7] ..... H01L 21/302
(52) U.S. Cl. ..... 438/691; 438/692; 156/345
(58) Field of Search ..... 438/690, 691, 438/692, 693; 451/259, 287, 288; 156/345

(56) References Cited

U.S. PATENT DOCUMENTS 5,578,529 A * 11/1996 Mullins ..... 437/228
5,679,063 A 10/1997 Kimura et al. ..... 451/287
5,709,593 A 1/1998 Guthrie et al. ..... 451/287
5,785,585 A * 7/1998 Manfredi et al. ..... 451/288
5,837,610 A * 11/1998 Lee et al. ..... 438/692
5,868,608 A * 2/1999 Allman et al. ..... 451/72
5,997,392 A * 12/1999 Chamberlin et al. ..... 451/446
6,030,487 A * 2/2000 Fisher, Jr. et al. ..... 156/345
6,110,012 A * 8/2000 Maury et al. ..... 451/36

FOREIGN PATENT DOCUMENTS

EP 0 763 402 A1 * 3/1997
EP 0 887 153 A2 12/1998

* cited by examiner

*Primary Examiner*—Benjamin L. Utech
*Assistant Examiner*—Kin-Chan Chen

(57) ABSTRACT

Improved CMP uniformity is achieved by providing improved control of the slurry distribution. Improved slurry distribution is achieved by, for example, the use of a slurry dispenser that dispenses slurry from a plurality of dispensing points. Providing a squeeze bar between the slurry dispenser and wafer to redistribute the slurry also improves the slurry distribution.

14 Claims, 4 Drawing Sheets

CM P UNIFORMITY

FIELD OF THE INVENTION

The present invention relates to semiconductor processing and, more particularly, improved CMP uniformity.

BACKGROUND OF THE INVENTION

In semiconductor processing, it is desirable to produce a uniform planar surface for subsequent processing such as, for example, lithography. Typically, a chemical mechanical polish (CMP) is employed to produce a planar surface on the substrate.

Generally, CMP systems hold a thin flat wafer of semiconductor material in contact, under a controlled downward pressure, with a polishing pad that moves relative to the semiconductor wafer. The semiconductor wafer may be stationary or it may also rotate on a carrier that holds the wafer. A backing film is optionally positioned between the wafer carrier and the wafer. The polishing platen is typically covered with a relatively soft wetted pad material such as blown polyurethane.

A liquid compound or slurry is often provided between the semiconductor wafer and the polishing pad to facilitate polishing of the wafer. The slurry serves to lubricate the moving interface between the semiconductor wafer and the polishing pad while mildly abrading and polishing the semiconductor wafer surface. Typical slurries comprise, for example, silica or alumina in a solution.

Due to normal usage, the surface of the pad becomes uneven. The non-uniform surface of the pad causes a non-uniform polish, resulting in a relatively uneven substrate surface. A non-uniform substrate surface is undesirable as it adversely affects subsequent processes, decreasing manufacturing yields. Typically, to combat the adverse affects of a non-uniform pad, it is periodically conditioned to smooth its surface. However, even with periodic conditioning of the pads, non-uniformities in the substrate surface after CMP still occurs.

In view of the foregoing, improve CMP uniformity is desirable to improve manufacturing yield.

SUMMARY OF THE INVENTION

The invention relates to semiconductor manufacturing and, in particular, to improved polishing of wafers. In one embodiment, the invention improves the control of the slurry distribution during polishing. The improved control of the slurry distribution is achieved by providing a slurry dispenser which dispenses slurry onto the pad from a plurality of positions or locations. In one embodiment, the slurry is dispensed from a plurality of radial positions of the polishing pad. In another embodiment, the slurry is dispensed from a plurality of angular positions of the polishing pad. In yet another embodiment, the slurry is dispensed from a plurality of radial and angular positions of the pad. The radial and angular positions in which the slurry is dispensed can be varied or adjusted over time to account for changing conditions.

In another embodiment, a squeeze bar is provided in the path between the slurry and substrate. The squeeze bar is used to shape the slurry distribution. The squeeze bar can have a plurality of positions between the slurry dispenser and substrate to produce the desired slurry distribution. The squeeze bar can be provided with additional parameters to improve the control of the slurry distribution.

DESCRIPTION OF THE INVENTION

The invention relates generally to semiconductor processes and, more particularly, to improved CMP uniformity. In accordance with the invention, improved CMP uniformity is achieved by controlling the distribution of slurry during CMP.

Figure 1:
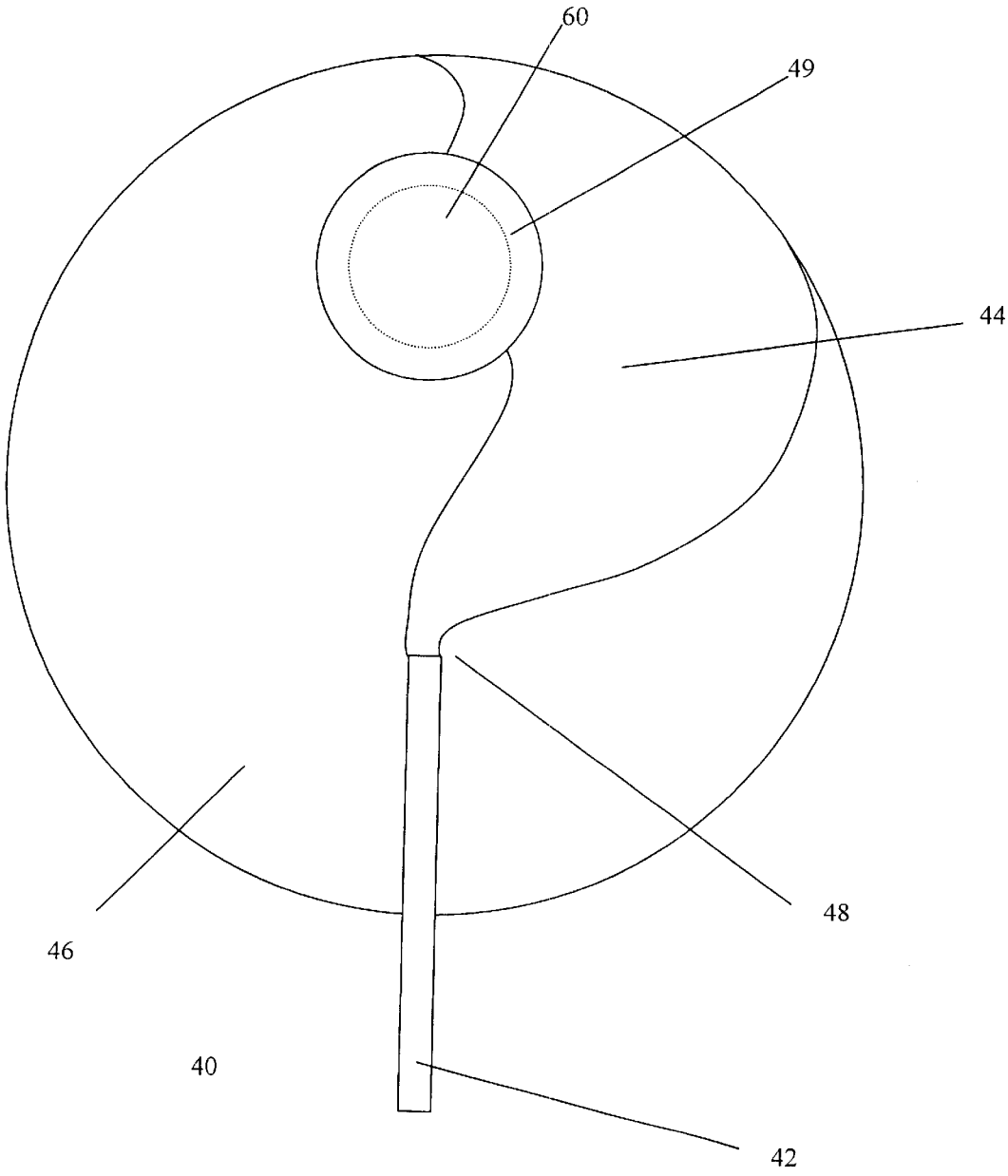
FIG. 1 shows a top view of a conventional CMP system.

Referring now to FIG. 1, a top view of a conventional CMP system 40 is shown. The CMP system comprises a slurry dispenser 42. The slurry dispenser delivers slurry 44 onto a polishing pad 46. The dispenser comprises a single outlet 48 from which the slurry is dispensed. The polishing pad is mounted on a platen which rotate the pad.

A substrate support or carrier 49 is provided for mounting a substrate, such as a semiconductor wafer. The substrate support holds a substrate in juxtaposition relative to the polishing pad. The carrier, in some embodiment, can be rotated to rotate the substrate.

The pressure applied on the substrate surface during polishing can be varied as desired. Adjusting the pressure on the substrate surface can be achieved by varying the position of the platen with respect to the carrier, varying the position of the carrier with respect to the platen, or both. Additionally, the radial position of the substrate with respect to the pad can be varied as desired by moving the carrier, moving the platen, or both. The positions of the pad and carrier can be varied as desired to produce a more even wear on the pad, prolonging pad life.

As the slurry is dispensed from the outlet, it moves toward the outer periphery of the pad as a result of centrifugal force created by the rotating pad. The shape of the slurry as it is distributed on the pad is thus primarily determined by centrifugal force. Controlling the distribution of the slurry by centrifugal force can be difficult, often resulting in non-uniform distribution of slurry between the substrate and pad. This creates non-uniformity in the CMP process, adversely affecting manufacturing yields.

In accordance with one embodiment of the invention, non-uniformity in the CMP process is reduced by providing a slurry dispenser which has improved control over the slurry distribution. The slurry dispenser can thus produce a slurry distribution which, for example, improves uniformity in the CMP process.

Figure 2:
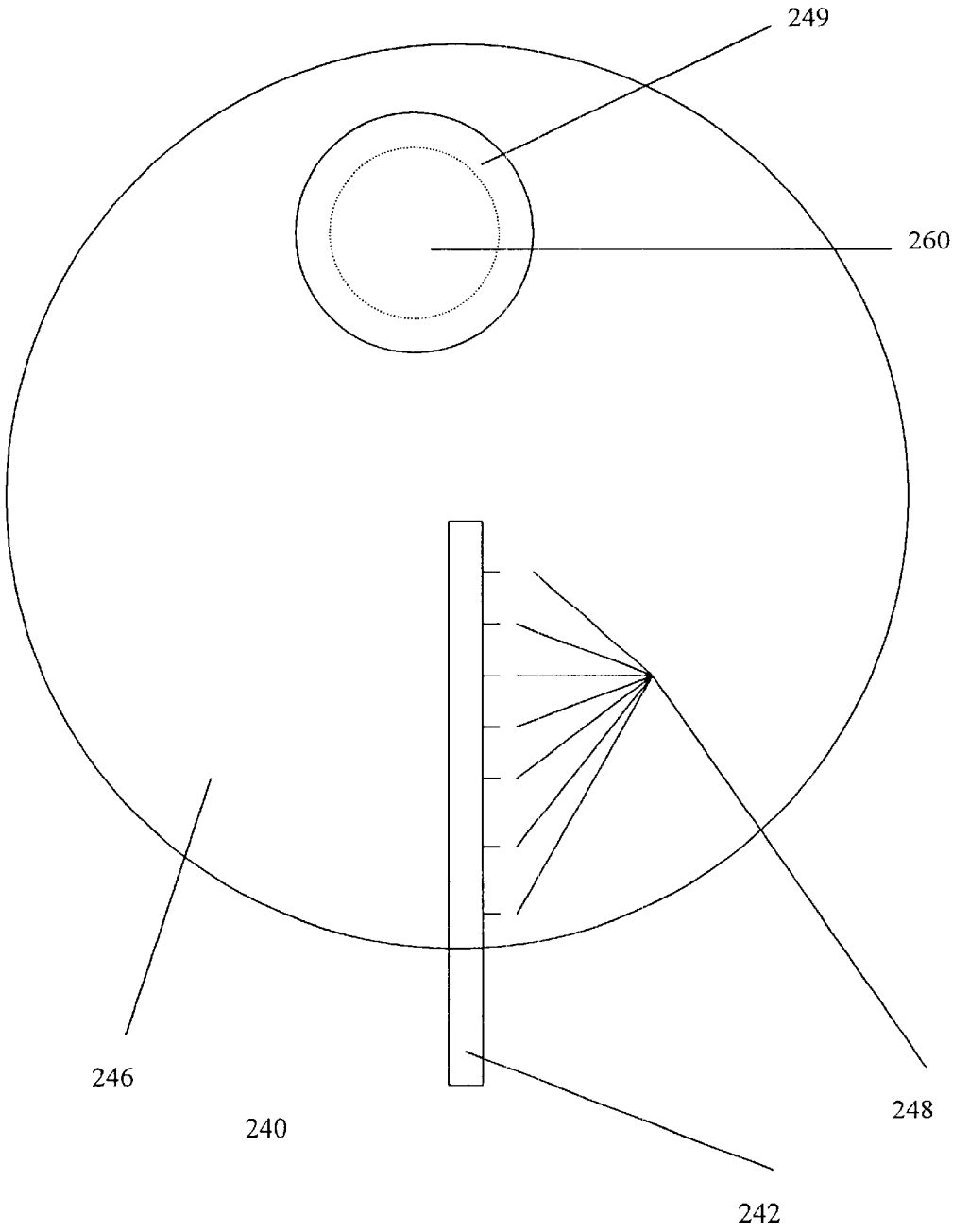
FIG. 2 shows a CMP system in accordance with one embodiment of the invention.

Referring to FIG. 2, a CMP system in accordance with one embodiment of the invention is shown. The CMP system 240 generally includes a polishing pad 246 mounted on a rotatable platen (not shown). A substrate carrier 249 is provided on which a substrate 260 such as a semiconductor wafer is mounted. A major surface of the substrate is, for example, mounted on a bottom surface of the carrier by vacuum pressure. Other techniques for mounting the substrate on the carrier, such as the use of electrostatic chuck, are also useful. An opposing major surface of the substrate is held in juxtaposition relative polishing pad 246.

The pressure applied on the substrate surface by the polishing pad can be varied as desired. Varying the pressure is achieved by changing the distance between the platen and carrier. This distance is varied by, for example, moving the platen with respect to the carrier, the carrier with respect to the platen, or both with respect to each other.

To prolong the life of the pad, the position of the substrate can be moved along a radius of on the pad. This can be achieved by either moving the platen, carrier, or both.

In one embodiment, the carrier comprises a rotatable carrier for rotating a substrate to be polish. The carrier can rotate the substrate in the same or opposite direction as the pad. Such a configuration allows both the substrate and pad to be rotated during polishing, controlling the relative velocity between individual points on the wafer and the pad. A non-rotatable carrier is also useful.

In accordance with one embodiment of the invention, a multi-point slurry distribution dispenser is provided to improve uniformity in the slurry distribution. The multi-point slurry dispenser comprises a plurality of outlets for dispensing slurry onto the pad from a plurality of locations.

In one embodiment, the multi-point slurry dispenser 242 comprises a discharge tube having a plurality of outlets 248 formed therein. The discharge tube, for example, may have a cylindrical shape. Other shapes or configurations such as a curved discharge tube, are also useful. As shown, the outlets are located along the length of the tube. The distance separating adjacent outlets, for example, can be equal. Having non-equal distances separating adjacent outlets is also useful. In another embodiment, the distances separating adjacent outlets can be adjusted to produce the desired slurry distribution. In one embodiment, the discharge tube positioned substantially along a radius of the pad. The slurry is dispensed onto polishing pad 246 through the outlets. By having a plurality of outlets, the slurry is dispensed onto different parts of the pad which results in a more controllable slurry distribution to improve the CMP process.

In one embodiment, the slurry is dispensed through the plurality of outlets at about a uniform rate. Typically, the total flow rate from the outlets is about 100–300 ml/min. Other flow rates are also useful and can be optimized for specific applications.

In another embodiment, the slurry flow rate at the individual outlets can be regulated. The ability to regulate the flow rate at the individual outlets increases the controllability of the slurry distribution or profile across polishing pad 246 in response to operating parameters. Operating parameters that can affect the slurry profile include, for example, rotational velocity of the polishing pad, type of slurry, and type of pad.

Various techniques can be employed to control the slurry flow rate at the individual outlets. In one embodiment, the flow rates at the individual outlets are controlled by providing a flow rate controller for a respective outlet. The flow rate controller, for example, comprises a control valve. The valve is controlled to produce the desired slurry flow rate. The value can be controlled electronically or manually. Other techniques to control the slurry flow rate such as, for example, varying the size of the individual outlets or providing different size orifices for the outlets, are also useful. Controlling the flow rate individually at some of the outlets or controlling the flow rate of sub-groups of the plurality of outlets is also useful. The flow rates at the outlets can be adjusted over time to account for changing conditions, during polishing, such as wafer surface patterns.

In accordance with the invention, the use of a multi-point dispenser improves controllability of the slurry distribution on the pad. Depending on the set of operating parameters and/or consumables, such as polishing pad profiles, polishing pad velocities, and load (e.g., wafer pattern), the slurry dispenser can be optimized to generate a slurry profile, to produce the desired polishing characteristics. For example, a uniform distribution of slurry between the wafer and pad can be produced to improve the uniformity of polish rate across the wafer. A non-uniform slurry distribution can also be produced to achieve the desired polishing characteristics.

The present invention is particularly useful in metal CMP. It has been proven in metal CMP that the slurry distribution has a direct impact on dishing of embedded structure, and thus, directly influences the resulting resistance of the metal lines. The ability to improve controllability of slurry distribution reduces the problems associated with the dishing/erosion of embedded metal structure.

Figure 3:
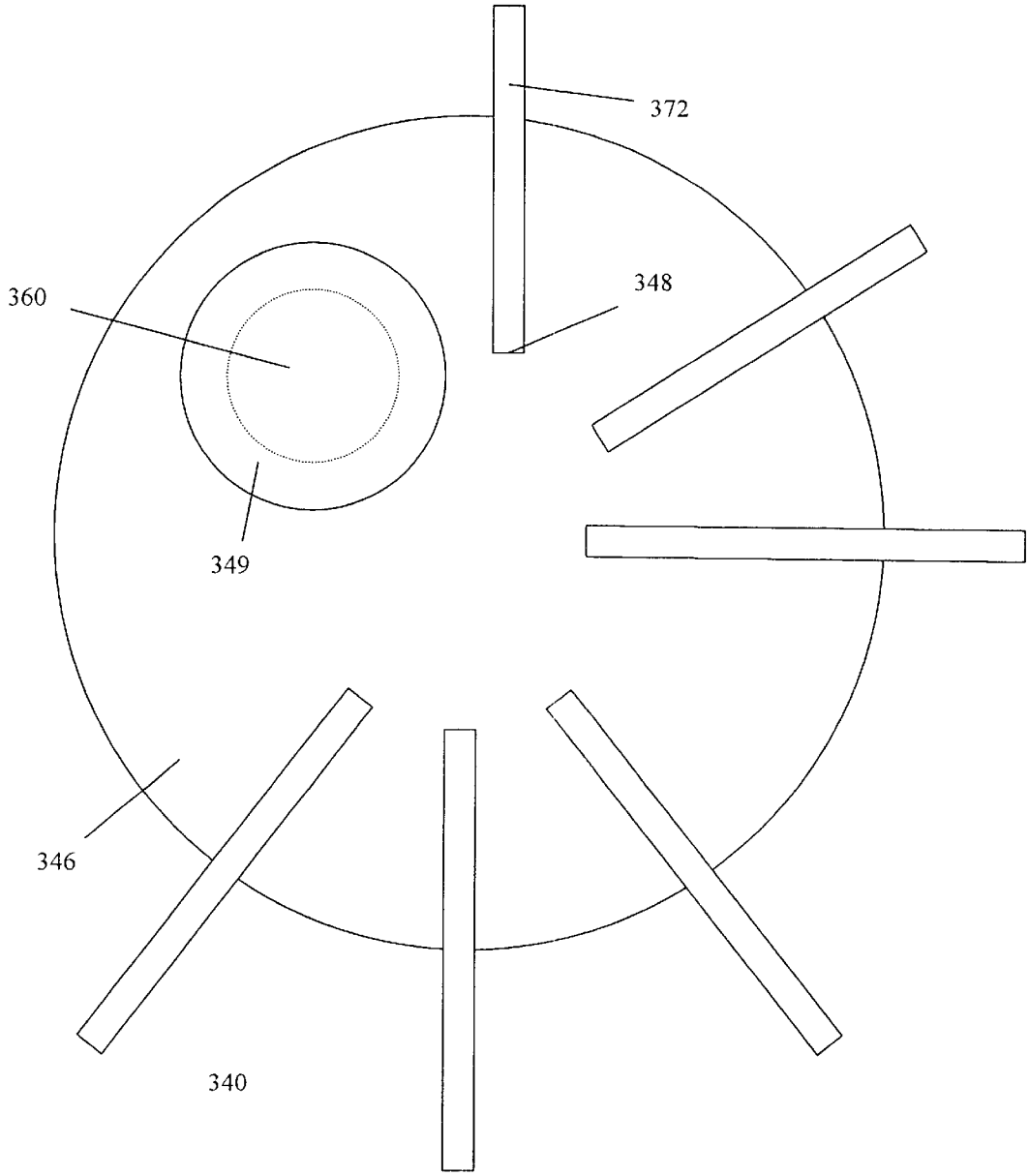
FIG. 3 shows a CMP system in accordance with another embodiment of the invention.

FIG. 3 shows another embodiment of the invention. As shown, a CMP system 340 comprises a polishing pad 346 mounted on a rotatable platen (not shown). A substrate carrier 349 is provided to position a substrate 360 in juxtaposition with respect to the polishing pad. The substrate can be rotated by the carrier in the clockwise or counterclockwise direction. The pressure applied on the substrate surface by the polishing pad can be varied as desired by changing the distance between the platen and carrier. The radial position of the substrate with respect to the pad can be varied to prolong pad life.

The CMP system comprises a dispensing system which includes a plurality of dispensers 372. As shown, a dispenser comprises a discharge tube that dispenses slurry from an outlet 348. The outlet, for example, is located at one end of the discharge tube. Other types of dispensers are also useful. The dispensers are positioned to dispense slurry from different angular positions of the polishing pad. Illustratively, the dispensing system comprises six dispensers. The dispensers can be, for example, equally spaced apart within a section of the pad that they occupy. Alternatively, the angular position of the dispensers within the section of the pad can be varied accordingly to produce the desired slurry distribution. The slurry flow rate of the dispensers can be controlled individually, as a group, or as subgroups, to further manipulate the slurry distribution. For example, various dispensers may have different flow rates or one or more may be turned off to produce the desired slurry distribution. Providing a dispensing system having plurality of dispensers can improve the control of the slurry distribution.

Additionally, the radial position of the slurry subsystem can be varied, controlling the angular and radial positions at which slurry is dispensed. A dispenser having a plurality of ports, as described in FIG. 2, is also useful. Using multiple multi-port dispensers can further enhance the controllability of the slurry distribution.

The use of a multiple dispensers that can dispense slurry from a plurality of angular and/or radial positions improves controllability of the slurry distribution on the pad. For example, the positions and flow rates of the slurry dispensers can be optimized in accordance with a given set of operating parameters and/or consumables such as polishing pad profiles, polishing pad velocities, and load (e.g., wafer pattern) in order to generate a slurry profile that produces the desired polishing characteristics. The positions and flow rates can also be adjusted over time, if necessary, to take into account of changing conditions during polishing, such as wafer surface patterns. This, for example, can improve the uniformity of polish rate across the wafer, resulting in improved yields.

Figure 4:
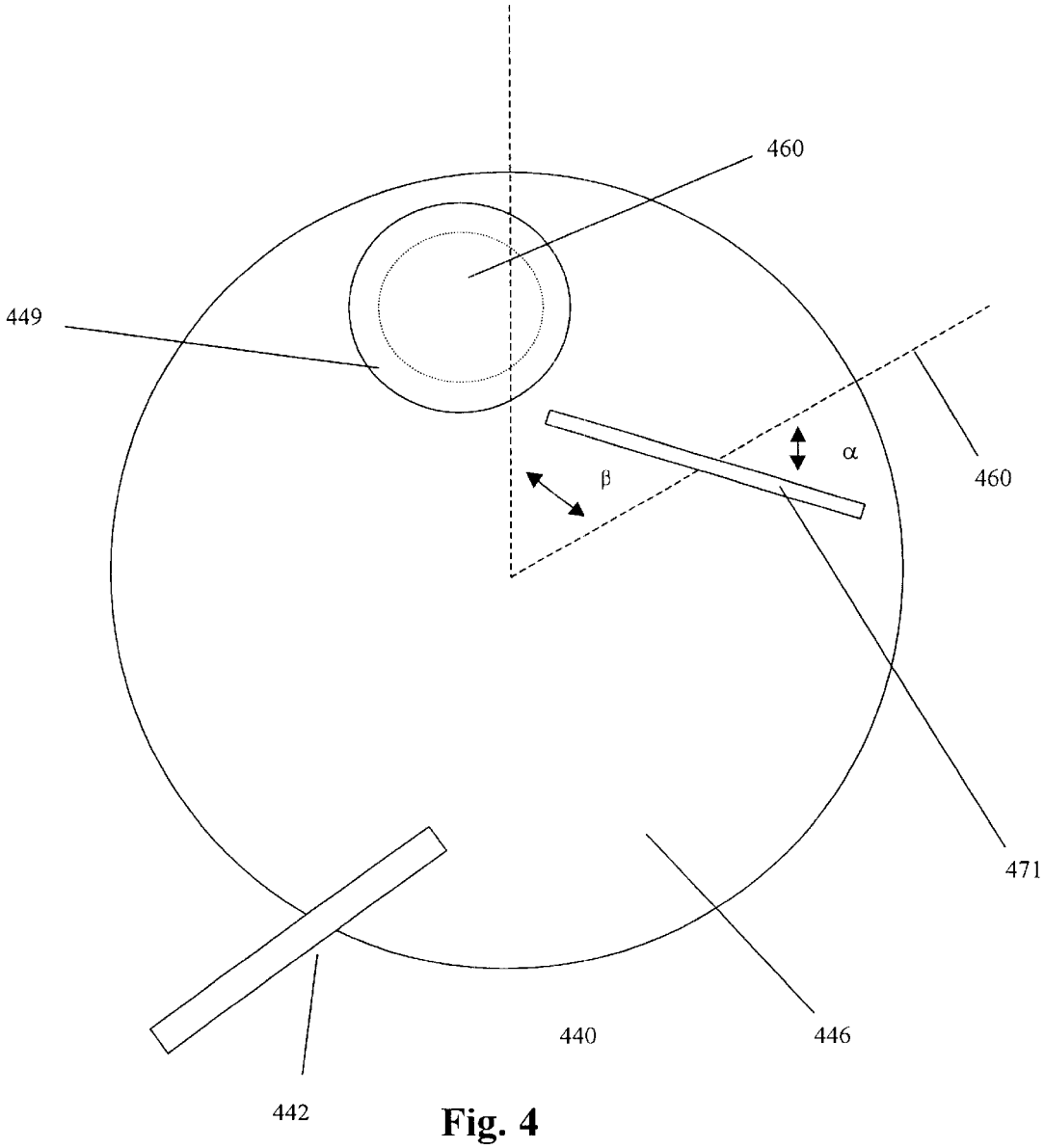
FIG. 4 shows yet another embodiment of the invention.

Referring to FIG. 4, an alternative embodiment of a CMP tool 440 is shown. The CMP tool includes a polishing pad 446 supported by a rotatable platen (not shown). A substrate or a wafer carrier 449 is provided on which a wafer 460 is mounted. A first surface of semiconductor wafer is typically held on a bottom surface of a wafer carrier by a vacuum force, and an opposing second surface of semiconductor wafer is held in juxtaposition relative to polishing pad with an applied pressure between the wafer carrier and polishing pad.

During polishing, the platen rotates the polishing pad, for example, counterclockwise. The wafer carrier may also rotate so that the surface of semiconductor wafer contacts the polishing pad while each are rotating. The wafer carrier may rotate in the same direction as polishing pad (i.e., counterclockwise), or it may rotate in a direction opposite that of polishing pad. A slurry dispenser 442 dispenses a required quantity of slurry to coat polishing pad. The rotary force is combined with the properties of the polishing surface of pad and the lubricating and abrasive properties of slurry to polish the semiconductor wafer.

In accordance with an embodiment of the invention, a squeeze bar 471 is positioned adjacent to the surface of the polishing pad along a radius 460 of the platen/polishing pad in the slurry path between the slurry dispenser and semiconductor wafer. The squeeze bar preferably comprises a wiper-type device that facilitates the distribution or redistribution of the slurry. Other squeeze bars that facilitate the distribution of the slurry are also useful. In one embodiment, the length of the squeeze bar is substantially equal to about the radius of polishing pad. Other lengths, which facilitate the distribution of the slurry as desired, are also useful.

The angular position β of the radius can be varied from 0° to D°, where 0° is the angular position of the substrate on the pad and D° is the angular position of the dispenser with respect to the substrate on the pad. Positioning of the squeeze bar can be achieved, for example, by providing a movable squeeze bar support arm which extends over polishing pad. Other types of squeeze bar support that can vary the position of the squeeze bar along a radius of the polishing pad can also be useful.

The squeeze bar provides an additional parameter to control the slurry distribution. The angular position β of the squeeze bar can be varied between 0° to D° to produce a slurry distribution that results in the desired polishing characteristics. For example, a more uniform slurry profile can be produced on the pad prior to contacting the substrate to result in greater polish uniformity across the wafer.

The position of the squeeze bar along the radius can have additional degrees of freedom to provide additional parameters for controlling or further refining the slurry distribution. In one embodiment, the squeeze bar can be located in a plurality of positions along the radius β. To facilitate shifting the squeeze bar along the radius, the squeeze bar support can be modified to include a track or runner for sliding the squeeze bar. The squeeze bar support can be provided with a rotator for rotating the squeeze bar. This enables the squeeze bar to be oriented in a plurality of angles α with respect to the radius β of the polishing pad.

The pressure between the squeeze bar and polishing pad can be regulated to further control the slurry distribution. Regulating the pressure can be achieved by controlling the height of the squeeze bar relative to the polishing pad. Increasing the pressure can produce a thinner and more uniform thin slurry film across the surface of the polishing pad. This can be achieved by, for example, providing a squeeze bar support that can adjust the height of the squeeze bar and/or a platen that can vary the height of the polishing pad.

The angle of the squeeze bar relative to the pad as well as its height can also be adjusted. Varying the angle of the squeeze bar may be useful to control the slurry distribution. The angle of the squeeze bar can be adjusted by, for example, providing a squeeze bar support that can tilt the squeeze bar and/or a platen that can be tilted.

Thus, the different parameters of the squeeze bar can be varied to control the slurry distribution to produce desired polishing characteristics. The parameters, for example, can be optimized according to a set of operating parameters and/or consumables such as polishing pad profiles, polishing pad velocities, and load (e.g., wafer pattern) to generate a slurry profile as desired to produce a uniform distribution of slurry between the wafer and pad.

The squeeze bar can also be combined with the multipoint dispenser to provide additional controllability in the slurry distribution. One or more parameters can be adjusted over time to take into account of changing conditions during polishing.

While the invention has been particularly shown and described with reference to various embodiments, it will be recognized by those skilled in the art that modifications and changes may be made to the present invention without departing from its scope. The scope of the invention should therefore be determined not with reference to the above description but with reference to the appended claims along with their full scope of equivalents.

What is claimed is:

1. A method for controlling a slurry distribution during polishing of a semiconductor wafer comprising the steps of:

rotating a polishing pad;

dispensing a slurry from a plurality of dispensers, wherein at least one of the plurality of dispensers comprises a plurality of controllable slurry dispensing outlets for controlling a slurry flow rate onto the polishing pad, wherein the plurality of dispensers dispense slurry onto the polishing pad at different angular positions; and shaping the slurry on the polishiing pad with a squeeze bar, wherein an angular position of the squeeze bar with respect to a major plane of the polishing pad is adjustable.

2. The method as recited in claim 1 above, wherein the plurality of controllable slurry outlets are located along a length of each dispenser.

3. The method as recited in claim 1, wherein each dispenser is positioned substantially along a radius of the pad.

4. The method as recited in claim 1, wherein the controllable dispensing outlets comprise individually controllable slurry dispensing outlets for controlling the slurry flow rate.

5. The method as recited in claim 1, wherein the squeeze bar is located substantially along a radius of the polishing pad in a slurry path between a wafer and the dispensers.

6. The method as recited in claim 5 wherein the squeeze bar can be oriented in a plurality of angles with respect to the radius.

7. The method as recited in claim 5, wherein the squeeze bar can have a plurality of positions along the radius.

8. The method of claim 1, wherein the controllable slurry dispensing outlets comprise individually controllable slurry dispensing outlets.

9. The method of claim 1, wherein the controllable slurry dispensing outlets are controlled by a flow rate controller.

10. The method of claim 9, wherein the flow rate controller comprises a control valve.

11. The method of claim 1, wherein the slurry flow rate is controlled by varying the size of each of the controllable slurry dispening outlets.

12. The method of claim 1, wherein the controllable slurry dispensing outlets comprise individually controllable slurry dispensing outlets.

13. The method of claim 1, wherein the squeeze bar is slidable along a radius of the polishing pad.

14. The method of claim 1, wherein a pressure between the squeeze bar and the polishing bar is controllable.

* * * * *